United States Patent [19]

Laauwe

[11] 4,314,658

[45] Feb. 9, 1982

[54] VISCOUS PRODUCT DISPENSING SQUEEZE BOTTLE HAVING A SELF-VENTING AUTOMATIC SHUT-OFF VALVE

[76] Inventor: Robert H. Laauwe, 237 Green Ridge Rd., Franklin Lakes, N.J. 07417

[21] Appl. No.: 116,853

[22] Filed: Jan. 30, 1980

[51] Int. Cl.[3] ..... B05B 11/04

[52] U.S. Cl. ..... 222/213; 137/197; 137/588; 222/481; 222/494

[58] Field of Search ..... 222/212, 213, 215, 481, 222/481.5, 493, 494, 495, 496, 497, 513, 514, 525; 137/197, 199, 588

[56] References Cited

U.S. PATENT DOCUMENTS

| | | | |
|---|---|---|---|
| 1,880,103 | 9/1932 | Murdoch | 222/494 |
| 1,925,926 | 9/1933 | Kunkel | 222/494 |
| 2,556,571 | 6/1951 | Bobbs et al. | 222/498 X |
| 4,057,177 | 11/1977 | Laauwe | 222/215 |
| 4,133,457 | 1/1979 | Klassen | 222/212 |
| 4,141,474 | 2/1979 | Nilson | 222/493 |
| 4,226,342 | 10/1980 | Laauwe | 222/494 |

*Primary Examiner*—Robert J. Spar
*Assistant Examiner*—Fred A. Silverberg

[57] ABSTRACT

An elastic squeeze bottle which springs back to shape after collapse by squeezing, contains a viscous product and has a normally closed valve opened by the displaced product and which automatically closes again when the squeezing is terminated. So that air can enter the bottle to replace the displaced product, the valve has a permanently open package proportioned so that the air can be sucked into the bottle, but the passage being too small to permit the viscous product to gravitationally leak from the bottle through the passage.

3 Claims, 10 Drawing Figures

Fig. 1.
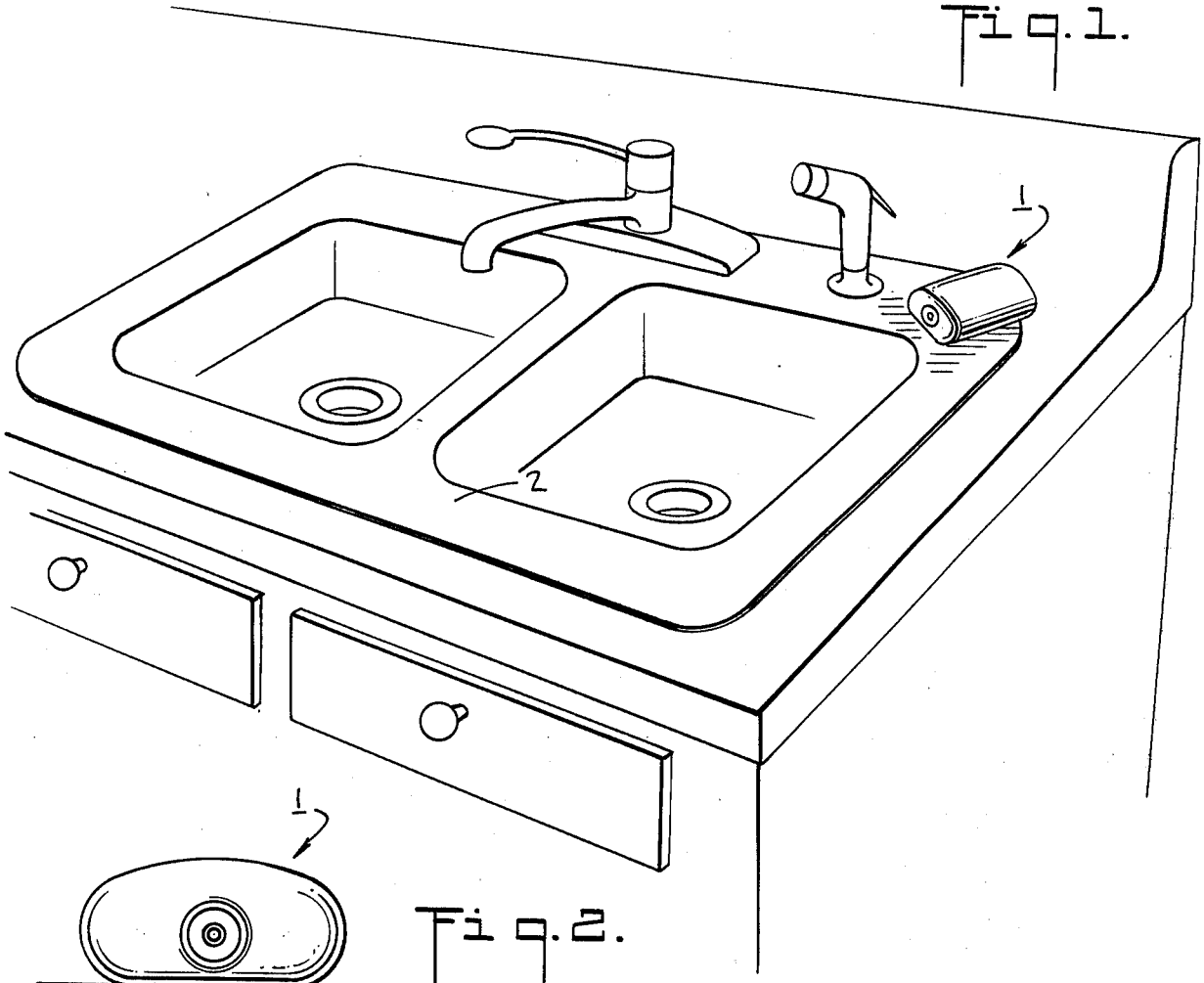
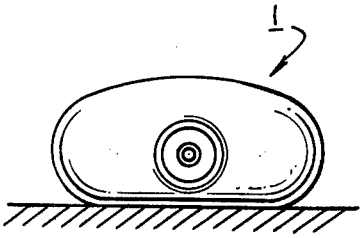
Fig. 2.
Fig. 3.
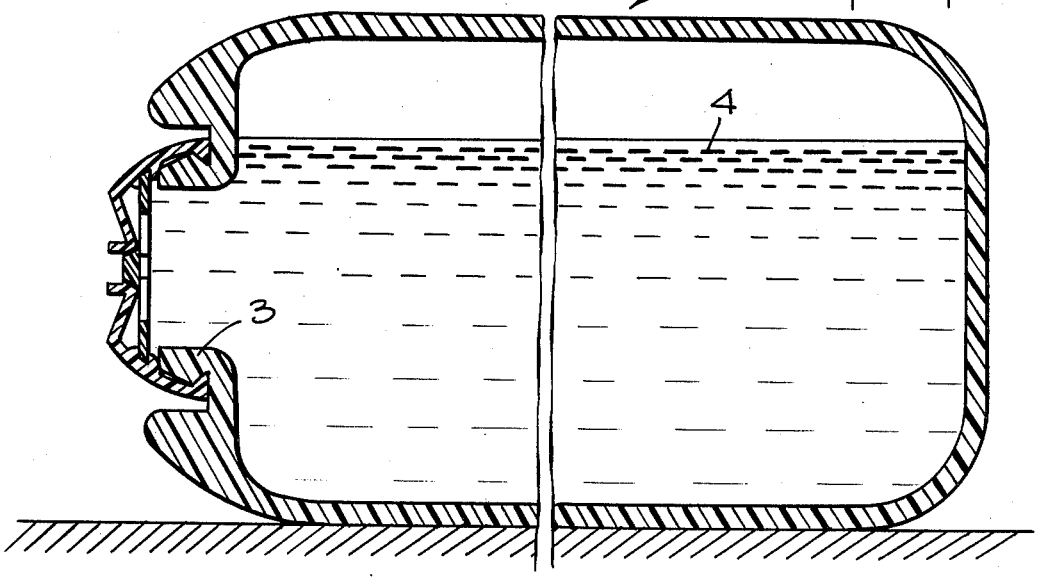

Fig. 4.
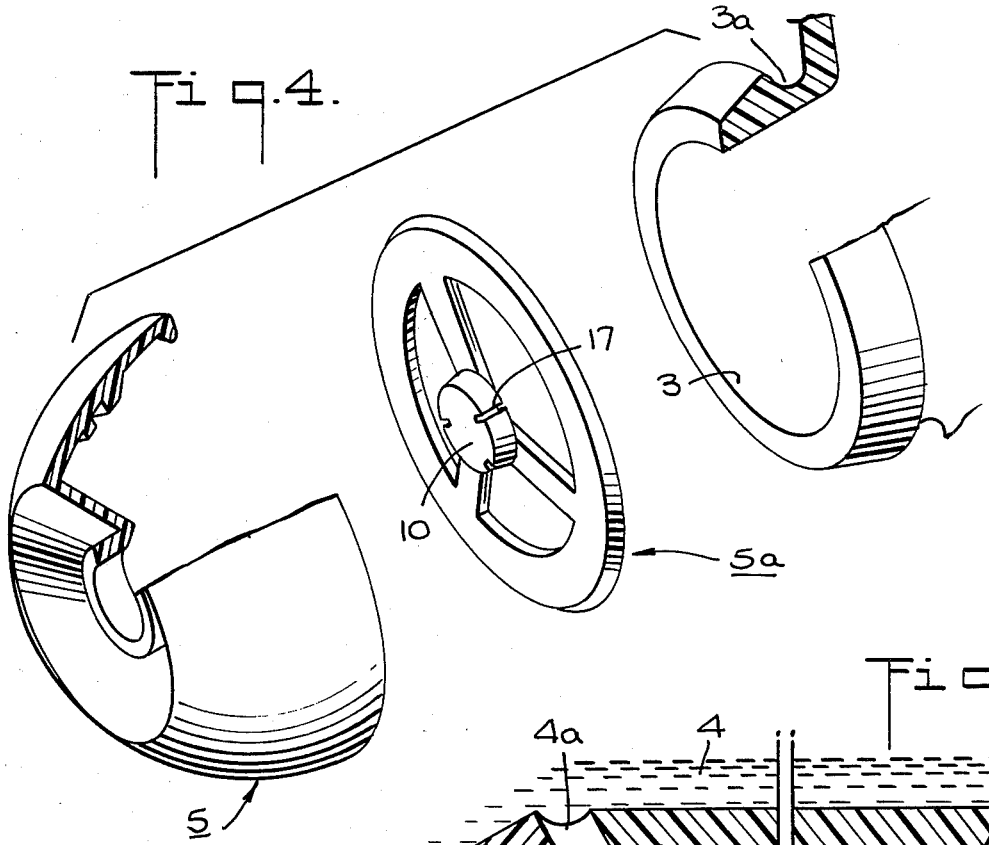
Fig. 7.
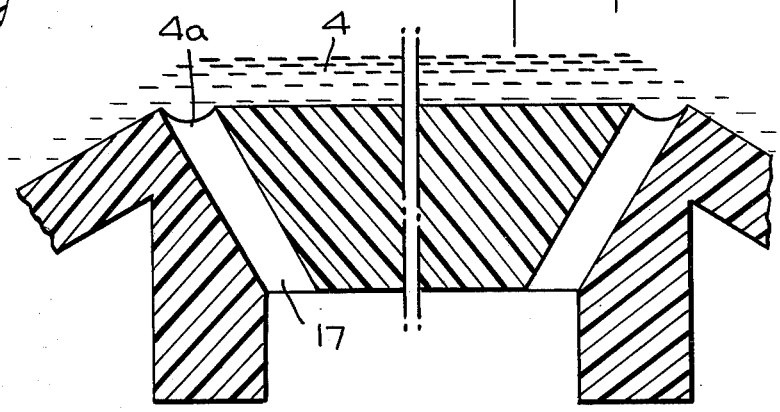
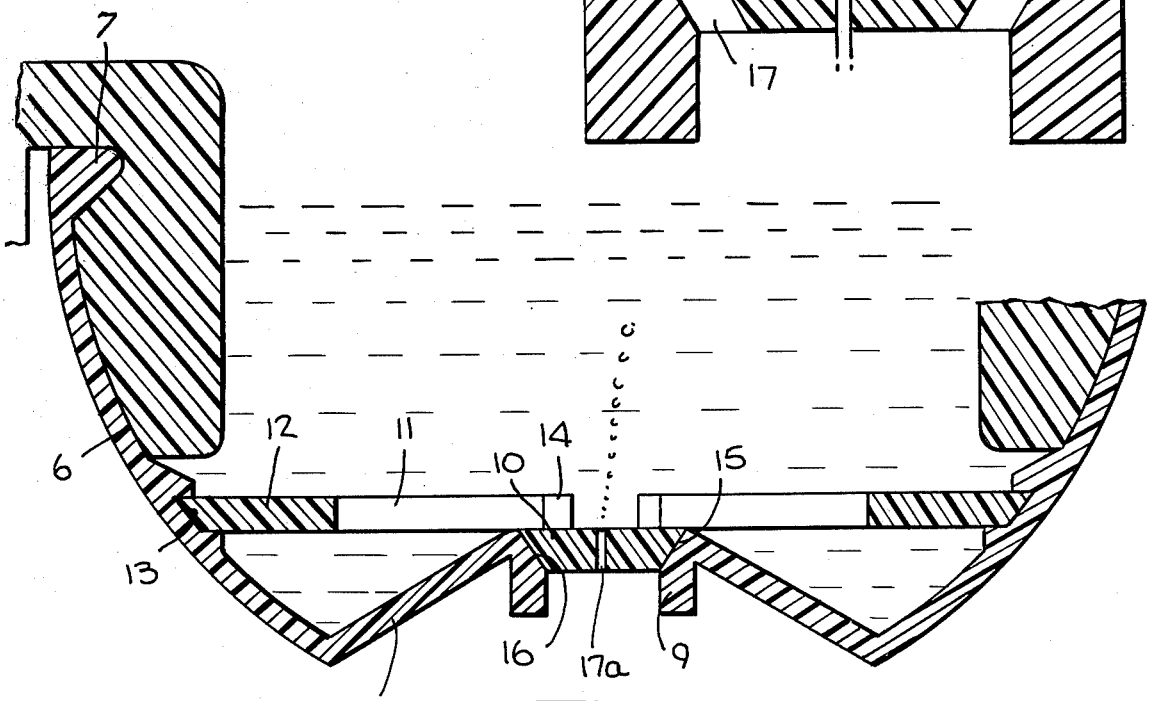
Fig. 10.

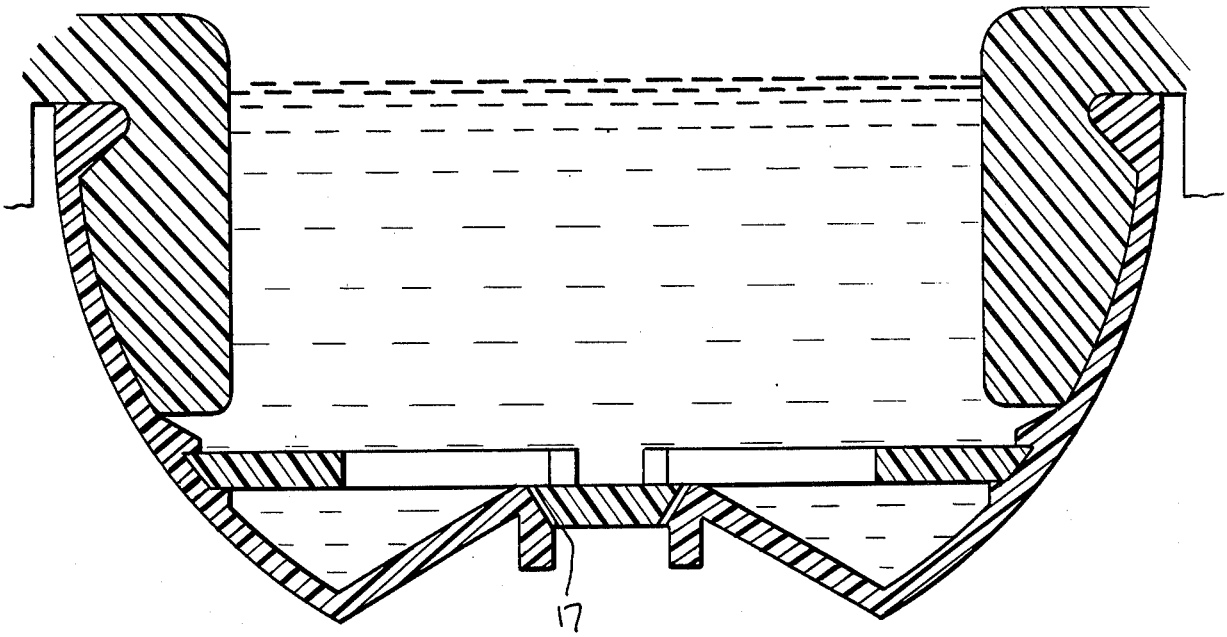
Fig. 5.
Fig. 6.
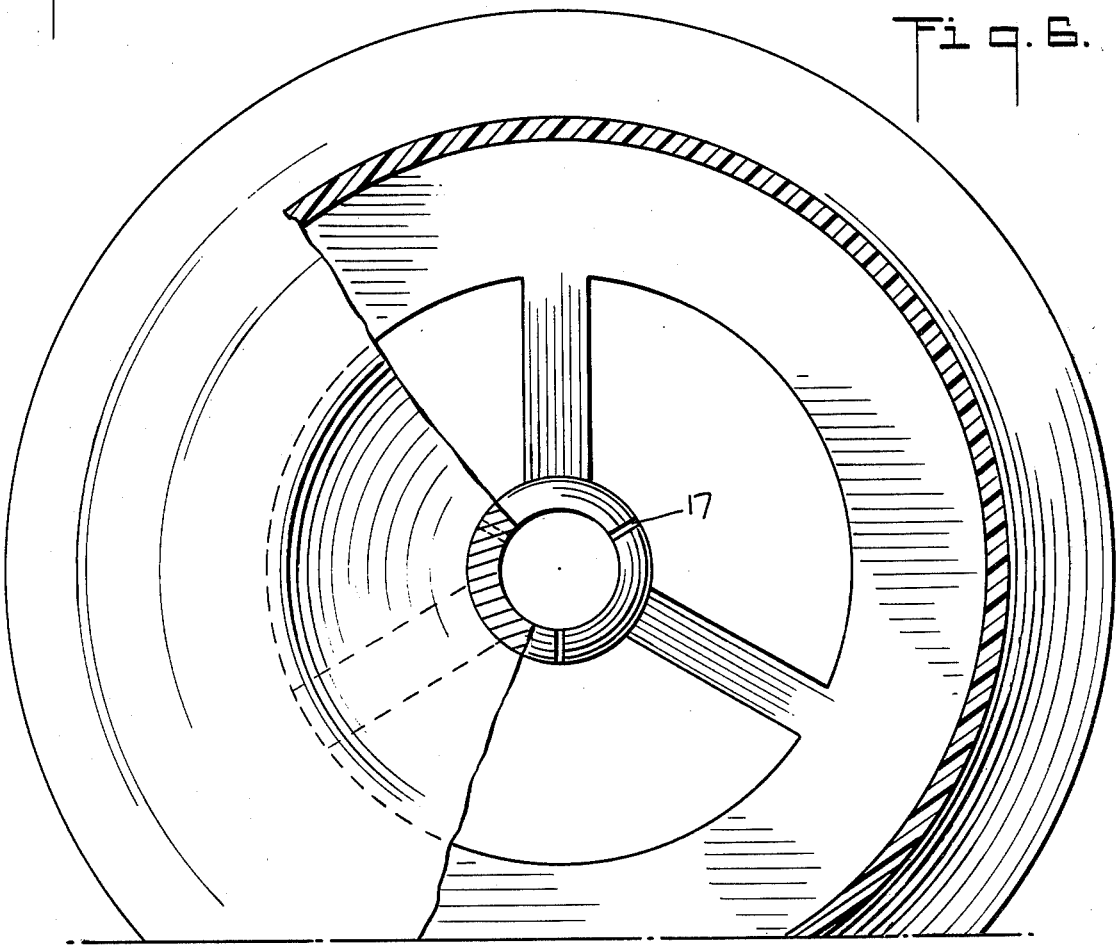

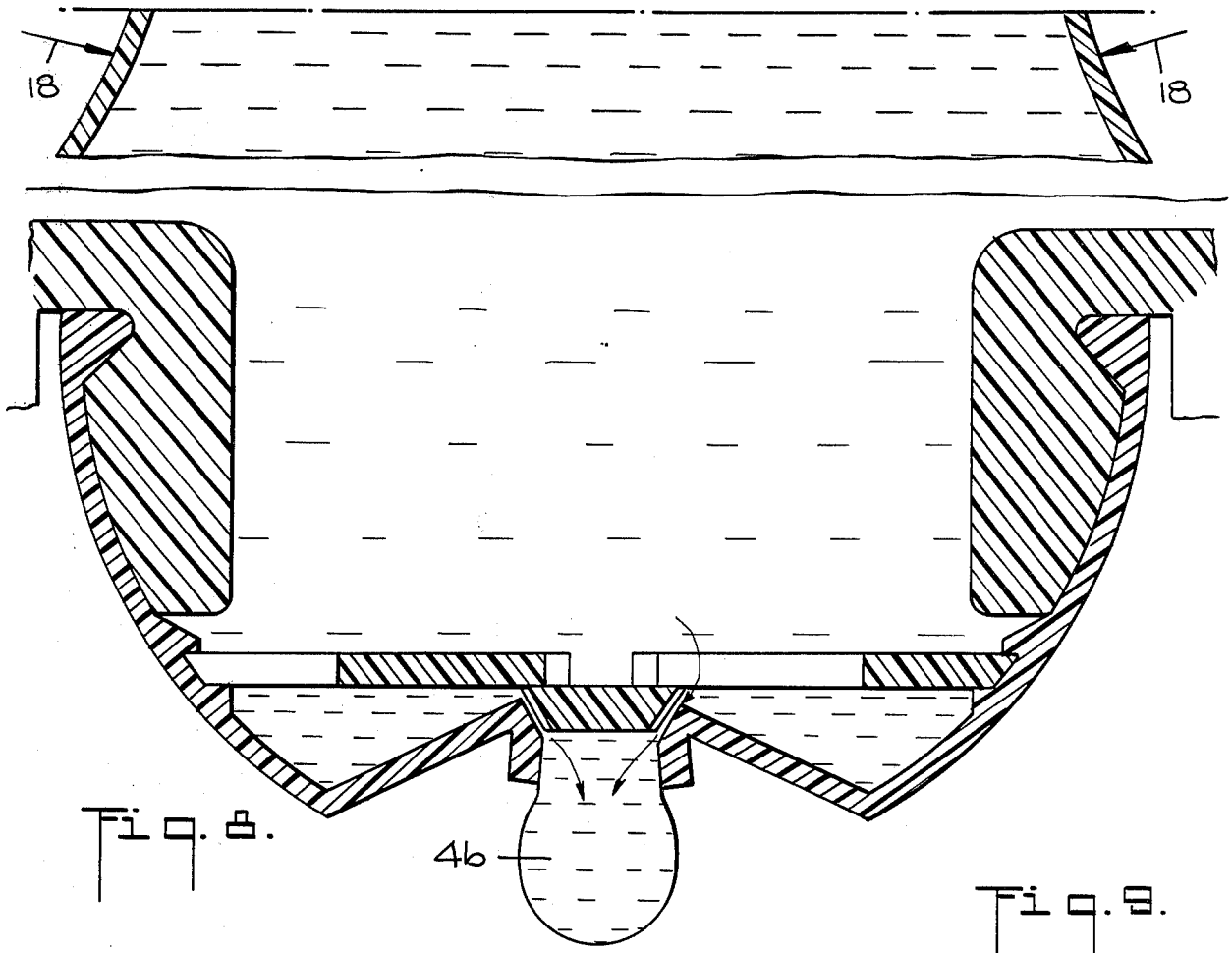
Fig. 8.
Fig. 9.
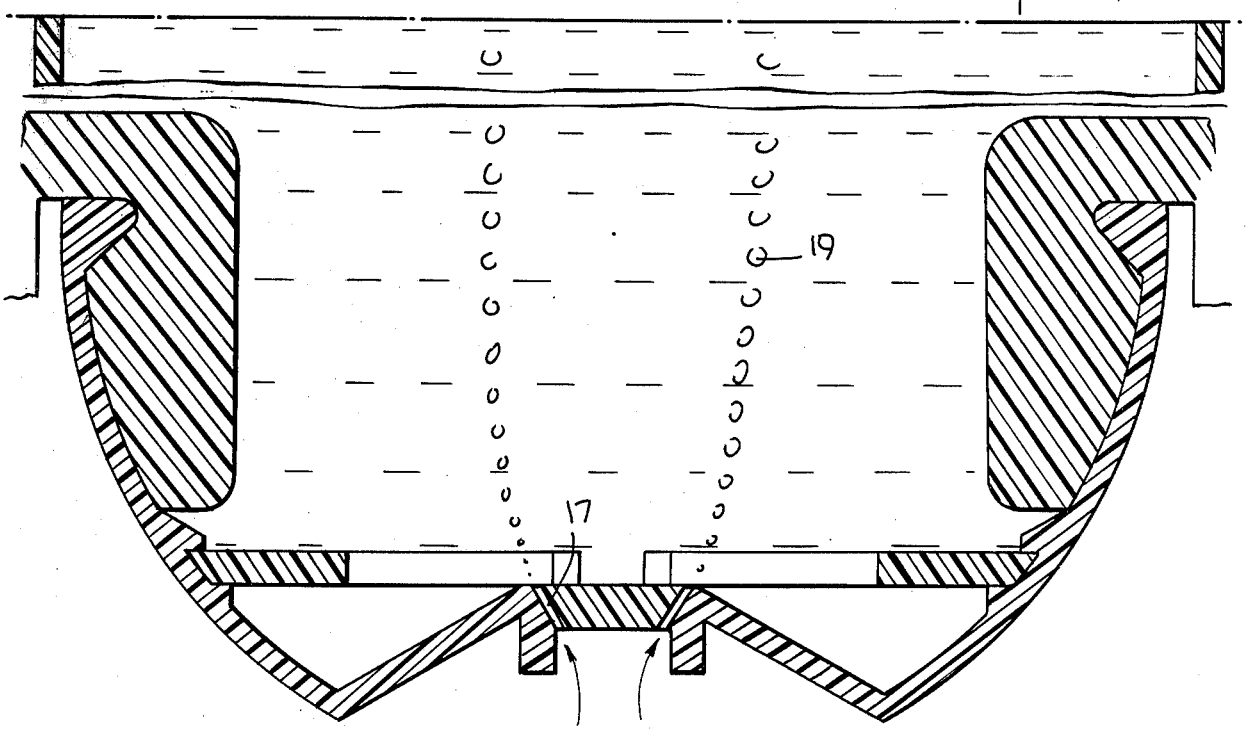

VISCOUS PRODUCT DISPENSING SQUEEZE BOTTLE HAVING A SELF-VENTING AUTOMATIC SHUT-OFF VALVE

BACKGROUND OF THE INVENTION

An elastic squeeze bottle, when collapsed by squeezing, should resiliently return after squeezing, to its normal shape.

In this respect, it is different from other collapsible containers made of malleable material and which remain collapsed after squeezing as in the case of the conventional tube containing toothpaste.

Squeeze bottles are used to package viscous products, such as hair shampoo, diswashing soaps and food products, such as ketchup. Such a package conventionally has the bottle mouth provided with a dispensing spout closed by a screw cap or the like to prevent leakage of the product when the package is shipped or layed on its side by the user.

For greater convenience, a squeeze bottle can be provided with an automatic value which is elastically biased to normally closed position and which is opened by the pressure of the product displaced when the bottle is squeezed and more or less collapsed for dispensing the bottled product. Thereafter, to permit air to be sucked back into the bottle so it can resiliently return to its uncollapsed or normal shape, the valve must be provided with a check valve which permits inward passage of the air but prevents outward passage of the product.

An example of an automatic valve capable of handling such products is disclosed by the Laauwe U.S. Pat. No. 4,057,177, Nov. 8, 1977. In this case the valve embodies a check valve in the form of a so-called duck bill. A substantially improved form is disclosed by the Laauwe pending application Ser. No. 969,796, filed Dec. 15, 1978 on which U.S. Pat. No. 226,342 issued Oct. 7, 1980.

Both of the above valves are unique in that they are operative when the squeeze bottle contains a viscous product. The type of valve involved has conventionally been designed with an elastic diaphragm having a central discharge or dispensing orifice and which, acting like a Belleville spring, is pressed by its inherent resiliency against an inner valve head, the diaphragm surrounding its orifice forming a valve seat. With viscous material between the mating surfaces of the valve head and valve seat, it was previously necessary to make the diaphragm so strongly elastic to squeeze the product from the valve surfaces for closing, that the squeezing pressure on the bottle was too great to be acceptable to the public. The Laauwe valves have overcome this problem, the valve of the pending application being particularly easy to open while positively reclosing.

However, both of the Laauwe valves incorporate a check valve for venting the bottle so that after squeezing the bottle can spring back to shape, both valves using the so-called duck bill. Both Laauwe valves use only two injection-molded plastic parts, which are snapped together, making them capable of mass production at low cost as required for their provision in numbers of millions as required to supply the market with the packages. However, if the need for the check valve could be eliminated, the parts and manufacturing costs could be reduced.

If a viscous product dispensing package using a squeeze bottle with an automatic valve could be mass produced at adequately low cost, it would not only be of great benefit in general, but would open up opportunities for the introduction of new packaging concepts.

For example, there has never been a practical replacement for the old familiar solid cake of soap which has for so long been preferred by the public because of its relatively low cost and because for use it had only to be picked up and used with water. However, this advantage is also a disadvantage because with the cake of soap lying on the kitchen sink, bathroom basin or tub receptacle, etc., a large amount of the soap melts and becomes a loss. Its substitution by a squeeze bottle having an automatic valve and containing viscous liquid soap, with the bottle possibly shaped to simulate the familiar cake of soap, would offer attractive possibilities from the commercial viewpoint as well as that of the purchasing public, if the package could be made to sell at a competitive price, keeping in mind that the saving in soap and the greater convenience could offset the price differential.

The main object of the present invention has been to provide a viscous product dispensing package comprising the squeeze bottle containing the viscous product, the automatically opening and reclosing valve of the type described, and completely eliminating the need for the venting action valve previously required.

SUMMARY OF THE INVENTION

The present invention attains the above object in the form of a viscous product dispensing packaging using the squeeze bottle made of elastic material and containing the viscous product, with the bottle having a mouth provided with the dispensing valve that is elastically biased normally-closed and opened by the pressure of the product when the product is displaced to the valve by squeezing and at least partially collapsing the bottle so as to dispense at least a portion of the bottled product through the valve. From what has been said above, elastic return of the bottle to its uncollapsed condition after the squeezing, requires the venting of air into the bottle to replace the dispensed product. The difference distinguishing the invention from all of the prior art principles is that the valve is made with one or more permanently opened passages extending from the outside of the bottle to its inside and having a flow area related to the differing viscosities of the air and the product so as to permit the air to be sucked through the passage to permit the elastic return of the bottle but so as to block gravitational flow of the viscous product through the passage so as to leak from the bottle.

It has been found that a product having the viscosity characteristic of liquid soaps, including shampoo soap, ketchup and other food products, such as syrups and honey, when having a volume that is characteristic of squeeze bottles provided to the public, cannot pass through a passage if the passage has a cross-sectional flow area small enough to block the product's flow. This holds true even if the bottle is inverted. On the other hand, the air of substantially lower viscosity can be sucked back through the passage for venting. The cross-sectional area of the passage can be easily determined by experimentation. For any particular viscous product packaged in the squeeze bottle, the product will leak upon inversion of the bottle if the passage is too large.

Reducing the size of the passage, namely its flow area or capacity, leakage can be reliably stopped. The minimum cross-sectional area of the passage depends largely on the venting rate desired compatible with insurance against leakage.

Because the product with only gravitational force cannot force itself into the passage opening, the passage remains clear for the venting action. Because the Laauwe valves, particularly the improved version, open easily under the product pressure produced by bottle squeezing, the pressure resulting from bottle squeezing is not great enough to cause the product to extrude into or through the passage.

DESCRIPTION OF THE DRAWINGS

The accompanying drawings illustrate a specific example of this new viscous product dispensing package, the various figures being as follows:

FIG. 1 is a perspective view illustrating the new package in a shape simulating an ordinary cake of hand soap and lying, as the cake often does, on a kitchen sink where it is constantly exposed to wetting;

FIG. 2 is an end view of the package as it appears in FIG. 1;

FIG. 3 is a longitudinal section of the new package in its horizontal position illustrated by FIG. 1;

FIG. 4 is an exploded view showing the construction of the valve itself;

FIG. 5 in cross section shows the valve as it appears when closed and with the bottle inverted, with the pressure of the viscous liquid directly applied to the venting passageways used in multiple in this instance;

FIG. 6 is a partially sectioned end view of the valve;

FIG. 7 by way of an enlarged scale cross section shows the manner in which the passageways block off passage of the viscous liquid;

FIG. 8 in cross section illustrates the action of the valve parts when the valve is opened;

FIG. 9 is like FIG. 8 but shows the venting action when the valve is closed; and FIG. 10 is like FIG. 9 but shows a modification.

DETAILED DESCRIPTION OF THE INVENTION

In FIG. 1 the new package 1 is shown on the ledge of a kitchen sink 2 where it is constantly exposed to wetting. This is a familiar position for a cake of soap where it is accessible particularly to children. The package 1 might also contain dishwashing liquid soap as well as liquid hand soap.

The bottle has a mouth 3, and as shown by FIG. 3 when lying on its side as shown by the end view of FIG. 2, the viscous product 4 can be above the top level of the mouth 3 even when a part of the product has been dispensed. Gravity can cause the product to run through the mouth. The valve of the present invention comprises only two injection-molded plastic parts. One part is a cap 5 comprising a skirt 6 having an end which is formed with an inward extending rib 7 which snaps in an annular groove 3*a* formed in the rim of the bottle's mouth 3. The cap 5 integrally forms the diaphragm 8 which receives the product pressure when the bottle is squeezed, the diaphragm 8 acting like a Belleville spring. Centrally the diaphragm 8 has a dispensing opening 9 which internally forms a tapered valve seat. The valve head 10 is stationarily mounted by spokes 11 which radiate from the head integrally to an annulus 12, the periphery of which is snapped in a groove 13 formed in the cap's skirt 6 on its inside.

As in the Laauwe pending application, the valve head 10 is in the form of a circular wafer and the spokes 11 have tips 14 connecting only with the bottom of the wafer 10 and extending radially to the peripheral part 12 in a plane below the wafer's bottom. In this way the wafer is positioned on and normal to the axis of the valve. The wafer is thin as compared to its diameter and has a small diameter as compared to the diameter of the skirt 6 at its groove 13, so an annular space is formed between the wafer and the peripheral disk portion 12 engaged in the groove 13 of the skirt 6. The periphery 15 of the valve head and the periphery 16 of the opening to the diaphragm 8 form substantially mating conical surfaces, illustrated as being about 45°. The wafer has a completely flat top and bottom and the spokes 11 have their inner tips connecting with only the wafer's bottom, the latter being otherwise free from obstructions in a downward direction. The wafer 10 need not be any thicker than the wall thickness of the diaphragm 8.

Because of the valve's unique construction, it can reclose easily after passing the viscous product, the peripheries 15 and 16 sliding slightly relative to each other upon closing due to the shape of the diaphragm 8 which is conical. For opening action, the skirt's portion integrally joining with the outer periphery of the diaphragm 8 and the diaphragm itself can flex outwardly under the product pressure. The opening action required is very small, the peripheries 15 and 16 only being required to separate slightly to dispense the viscous product.

Using the plastics normally used to mold the parts of dispensing valves in general, the diaphragm's bottom should preferably have a diameter not smaller than 0.65 inch. Preferably the thickness of the wafer and diaphragm should range from 0.005 inch to 0.03 inch. A typical maximum diameter of the wafer would be in the area of 0.320 inch, and a typical thickness would be 0.15 inch, which should also be the wall thickness of the diaphragm. These values are given to exemplify the small dimensions involved. The conical angularity of the diaphragm would range from 3° to 15° for example, with respect to the flat top of the wafer.

Because there is nothing below the valve head 10 to which the viscous product can cling, and because of the small areas of the mating peripheries 15 and 16, it is unnecessary to make the diaphragm 8 so as to provide it with a large spring force for closing the valve head and seating reliably. Relatively easy bottle squeezing serves to open the valve and dispense the product.

To the foregoing extent, the valve of this new package embodies the principles of the valve disclosed by the Laauwe application.

The difference is that as can be seen from the drawings no duck bill or other kind of venting check valve is used. There is only the cap 5 and the flat insert, marked 5*a*, which carries the valve head 10 in the form of the flat small thin wafer described.

For the necessary venting, the valve head 10 is formed with three grooves 17 formed in the conical periphery 15 on which the valve seat surface 16 is in contact when the valve is in its closed condition. The number of slots used is not critical. Each slot 17 forms a passage between the surfaces 15 and 16 had having a cross-sectional area of flow area related to the viscosities of air and the viscous product so as to not only permit air to be sucked through the passage to permit venting and the elastic return of the bottle after being squeezed, but so as to block gravitational flow of the product through the passage. The precise flow area depends on the viscosity of the product and possibly on its other physical characteristics, such as its shear strength, and possibly slipperiness.

FIG. 5 shows the bottle inverted and free from leakage under the gravitational force of the product on each of the passages 17. FIG. 7 shows how the viscous product 4 presumably forms a meniscus 4*a* at the entrance at each passage 17, but because of its viscosity, unable to flow through the passage 17 so as to cause the valve to leak when the package is inverted.

FIG. 8 shows the bottle inverted and being partially collapsed by squeezing as indicated by the arrows 18 with the product being extruded for use as at 4*b*. Because of the small size of the grooves 17, the product does not fill these grooves although the entire valve head 10 is at this time surrounded by the product, insofar as has been ascertained. If the grooves do receive the product, it is known that upon release of the squeezing pressure at 18, venting occurs as illustrated by FIG. 9. The bubbles of air are easily visible rising through the product during venting action, as shown by FIG. 9, where the bottles are indicated at 19.

Squeezing of the bottle applies pressure to the product that is higher than the pressure resulting gravitationally from the product's weight, but because of the valve's construction the valve opens so easily that this pressure does not reach a value causing the meniscus 4*a* to break initially. If the product does fill the passages or grooves 17, the ambient air pressure is apparently adequate to force the product backwardly so that venting is obtained.

The theory of operation of the valve of this new package is not clearly established as yet. It is known from practical testing that with one or more passages appropriately proportioned relative to the viscous product contained by the squeeze bottle, that leakage does not occur when the package is not inverted or laid horizontally as illustrated by FIGS. 1 through 3, that easy squeezing of the bottle causes dispensing of the product properly through the dispensing opening 9, and that upon release of the pressure, venting occurs at a satisfactory rate to permit the squeezed bottle to return to its normal shape within an acceptable time period, even when the bottle is held inverted after squeezing.

Insofar as is known, the principals of this invention are applicable in the case of any of the products that would normally be packaged, such as hair shampoos, semi-liquid hand soap and food products, such as ketchup, syrups, etc.

These passages are shown formed in the valve head periphery because this provides a geometrically balanced or symmetrical arrangement. FIG. 10 is provided to show that only one passage 17*a* may be formed directly through the wafer or valve head 10.

The package of this invention required only three parts other than the product itself. The squeeze bottle should be made as usual from a plastic having the elasticity required for the bottle to spring back to shape after being collapsed more or less by squeezing. The spring-back should be adequate to suck the air through the venting passage or passages and possibly to clear them if they do contain some of the product, and it has been found that the normal squeeze bottle used for commercial packaging provides this degree of spring-back. The two valve parts 5 and 5*a* can be made by injection molding using uncomplicated molding die cavities with the material being any of those commonly used for injection-molded components of similar type. Assembly of the two valve parts and application to the filled squeeze bottles are operations easily capable of automation.

The skirt 6 is in the form of a rim having the elements 3*a* and 7 for mounting it to the bottle's mouth. The rim and the diaphragm 8 can be formed as an integral injection molded plastic part. The only other part needed is the flat small wafer or valve head 10 mounted only via its bottom by the tips of the spokes 11 radiating to the flat annulus 12, again an easily injection molded part. The two parts are simply snapped together for assembly of the valve. No check valve is needed for bottle venting. The small passage 17*a* or passages 17 provide adequate venting while preventing leakage of the product when the bottle is unsqueezed, even though stored upside-down.

What is claimed is:

1. A viscous product dispensing package comprising a squeeze bottle made of elastic material and containing the viscous product, said bottle having a mouth provided with a dispensing valve that is elastically biased normally closed and opened by the pressure of said product when the product is displaced to the valve by squeezing and at least partially collapsing the bottle so as to dispense at least a portion of the product through the valve, elastic return of the bottle to its uncollapsed condition after said squeezing requiring the venting of air into the bottle to replace said portion of the product, said valve having at least one permanently open passage extending from the outside of the bottle to its inside and having a flow area related to the viscosities of air and said product so as to permit air to be sucked therethrough to permit said elastic return to the bottle and block gravitational flow of said product through the passage, said valve having a rigidly positioned rigid valve head having a periphery, and an elastically flexible diaphragm having a central opening with a periphery normally pressed on said periphery of the valve head by the elasticity of the diaphragm when the valve is in its normally closed condition, said passage being formed through said rigid valve head and the valve head having an outside exposed substantially directly to the ambient air outside of said valve.

2. The package of claim 1 which said valve has a base comprising a circular rim, means for connecting said rim to a squeeze bottle's mouth, a circular wafer forming said valve head, and spokes connecting with and radiating from the wafer's bottom and extending radially to the rim in a plane below said bottom and positioning the wafer on and normal to the rim's axis, said wafer being thin as compared to its diameter and having a small diameter as compared to the rim's diameter and forming an annular space between the wafer and rim; and a cap comprising said elastically flexible annular diaphragm positioned above said plane, and a depending skirt connected to said rim, said peripheries having substantially mating conical surfaces, said wafer having a flat top and bottom, said spokes having inner tips which connect with said bottom only and said bottom being otherwise free from obstructions in a downward direction, said passage being formed in the periphery of said wafer.

3. The package of claim 1 in which said valve has a base comprising a circular rim, means for connecting said rim to a squeeze bottle's mouth, a circular wafer forming said valve head, and spokes connecting with and radiating from the wafer's bottom and extending radially to the rim in a plane below said bottom and positioning the wafer on and normal to the rim's axis, said wafer being thin as compared to its diameter and having a small diameter as compared to the rim's diameter and forming an annular space between the wafer and rim; and a cap comprising said elastically flexible annular diaphragm positioned above said plane, and a depending skirt connected to said rim, said peripheries having substantially mating conical surfaces, said wafer having a flat top and bottom, said spokes having inner tips which connect with said bottom only and said bottom being otherwise free from obstructions in a downward direction, said passage being formed by a hole formed through said wafer.

* * * * *

UNITED STATES PATENT AND TRADEMARK OFFICE

CERTIFICATE OF CORRECTION

PATENT NO. : 4,314,658

DATED : February 9, 1982

INVENTOR(S) : Robert H. Laauwe

It is certified that error appears in the above—identified patent and that said Letters Patent is hereby corrected as shown below:

Column 1, line 22, change "value" to --valve--.

Column 1, line 37, change "226,342" to --4,226,342--.

Column 4, line 61, after "16", change "had" to --and--.

Column 5, line 49, change "These" to --Three--.

Column 6, line 43, after "1" insert --in--.

Signed and Sealed this

*Eighteenth* Day of *May 1982*

[SEAL]

*Attest:*

GERALD J. MOSSINGHOFF

*Attesting Officer*

*Commissioner of Patents and Trademarks*